US007273018B2

(12) United States Patent
Strong

(10) Patent No.: US 7,273,018 B2
(45) Date of Patent: Sep. 25, 2007

(54) MODULAR FLOATING DOCK FRAME AND INTERCONNECTION SYSTEM

(76) Inventor: Gardner Strong, 43 Walnut Tree Dr., Colusa, CA (US) 95532

( * ) Notice: Subject to any disclaimer, the term of this patent is extended or adjusted under 35 U.S.C. 154(b) by 7 days.

(21) Appl. No.: 11/317,853

(22) Filed: Dec. 22, 2005

(65) Prior Publication Data

US 2007/0144424 A1 Jun. 28, 2007

(51) Int. Cl.
*B63B 35/44* (2006.01)
*B63C 1/00* (2006.01)

(52) U.S. Cl. ..... 114/266; 405/218

(58) Field of Classification Search ..... 114/266
See application file for complete search history.

(56) References Cited

U.S. PATENT DOCUMENTS 3,091,203 A * 5/1963 Usab ..... 114/266
4,078,515 A * 3/1978 Svirklys ..... 114/266
4,260,293 A * 4/1981 Peterson ..... 405/219
4,352,597 A * 10/1982 Kay ..... 405/219
4,940,021 A * 7/1990 Rytand ..... 114/267
5,845,594 A * 12/1998 Hallsten et al. ..... 114/263

* cited by examiner

*Primary Examiner*—Jesús D Sotelo
(74) *Attorney, Agent, or Firm*—Richard Esty Peterson

(57) ABSTRACT

A modular floating dock system utilizing steel frame modules that are interconnected to form the dock system desired, the modules preferably having a concrete deck and pontoons or floats with the modules being interconnected with high strength bolts with a primary shock pad being interposed between adjacent modules.

12 Claims, 7 Drawing Sheets

MODULAR FLOATING DOCK FRAME AND INTERCONNECTION SYSTEM

BACKGROUND OF THE INVENTION

This invention relates to a modular floating dock and in particular to a novel steel frame and interconnection system that can be incorporated into a variety of floating docks having different decks and floats.

Typical floating docks for marinas are constructed with modules that are interconnected to provide a walkway for access to docked boats and may include a network of primary and secondary walkways connected to fingers that define separate boat slips.

While usually assembled in protected harbors to minimize wave and swell action that may damage boats docked at the floating dock, the network must be strong enough to withstand damage from occasional storms. Since a floating dock network may be assembled over a substantial area, the interconnection system is subject to wind forces as well as wave action. To accommodate the compound forces, the network must necessarily have a degree of flexibility in the interconnection of modules. In prior systems, wooden stringers fastened along the sides of deck modules would interconnect adjacent modules and provide a degree of flexibility to the overall system. Wooden stringers, however, are not structurally uniform at the time of installation and structurally degrade from the elements during use.

Rigid interconnections are subject to tremendous localized and repetitious forces and eventually fail. Therefore, an interconnection that is sturdy but allows limited stress relieving flexing is preferred.

SUMMARY OF THE INVENTION

The interconnection system for floating docks of this invention is designed for the type of modular pontoon docks typically used in marinas or in other dock environments for smaller watercraft, typically private boats and yachts. A floating dock rises and falls with the water level to provide convenient ingress and egress to the watercraft stationed at the dock. This feature makes the floating dock particularly useful in tidal environments where daily tidal changes are easily accommodated by a floating dock. In the improved interconnection system of this invention, the strength of a steel frame platform is combined with an inexpensive steel connector for interconnecting adjacent modules.

In the preferred embodiments, welding is minimized to eliminate weakened locations subject to fatigue. The preferred embodiments are designed for use with a concrete deck which can be poured during fabrication to add to the structural integrity of the finished module. These and other features of the preferred embodiments are described in greater detail in the Detached Description of the Preferred Embodiments.

DETAILED DESCRIPTION OF THE PREFERRED EMBODIMENTS

Figure 1:
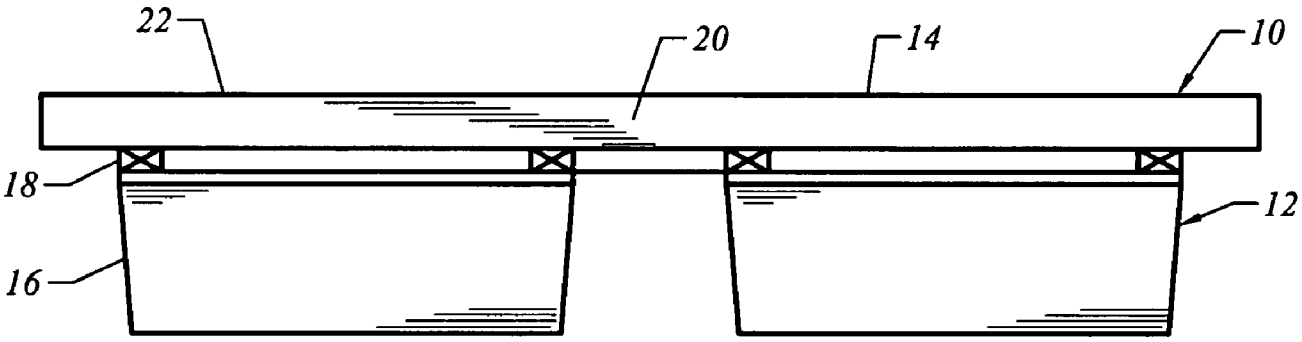
FIG. 1 is a side elevational view of a typical floating dock module of this invention.
Figure 2:
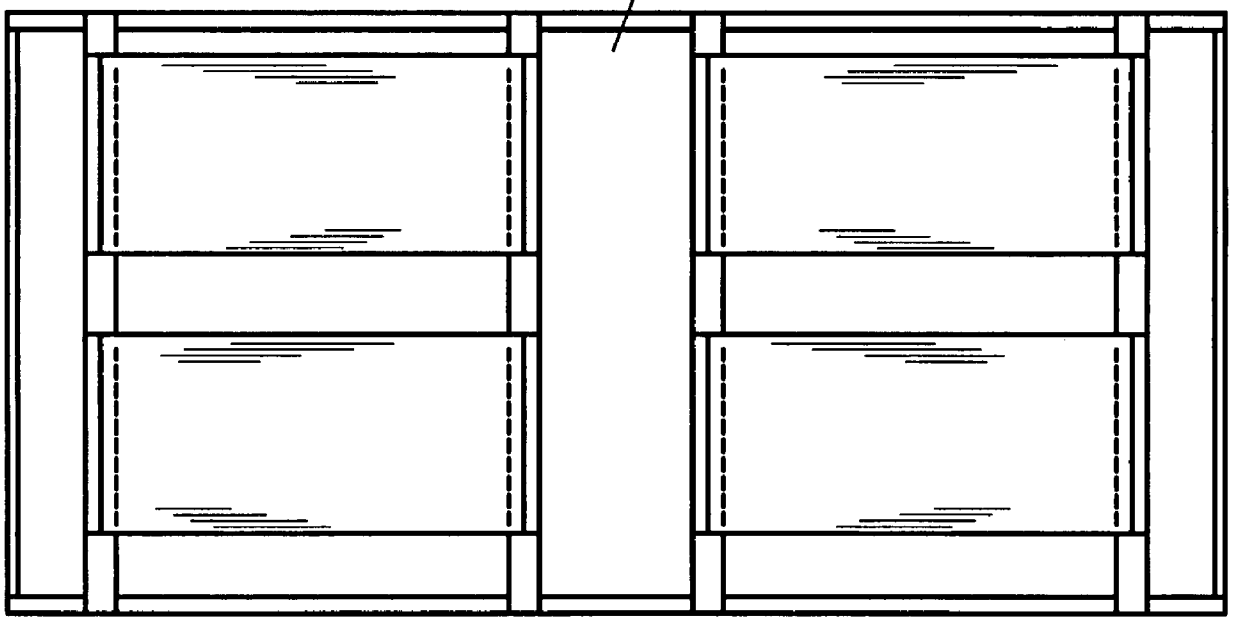
FIG. 2 is an underside view of the floating dock module of FIG. 1.

Referring to FIGS. 1 and 2, the modular floating dock frame and interconnection system is shown and designated by the reference numeral 10. The frame and interconnection system 10 is shown incorporated into a typical floating dock module 12 which includes a deck assembly 14, pontoons or floats 16 and spacers 18. The spacers can be either pressure treated wood or steel channel, located as necessary, to support the pontoons. It is to be understood that, while four pontoons 16 are shown with cross-beam spacers 18, other arrangements may be utilized to float and support the connected deck assembly 14. Customarily, some utility pathway or chase (not shown) for water and power is provided under the deck for the convenience of the dock users. In a floating dock system, a plurality of floating dock modules 12 are interconnected in a manner to provide the desired marina layout.

The deck assembly 14 is fabricated with a steel frame assembly 20 and, in the preferred embodiments, with a concrete deck 22. Other deck compositions may be utilized with minor modifications to the frame assembly 20. Use of concrete assists in improving the structural integrity of the finished deck assembly.

Figures 3, 4:
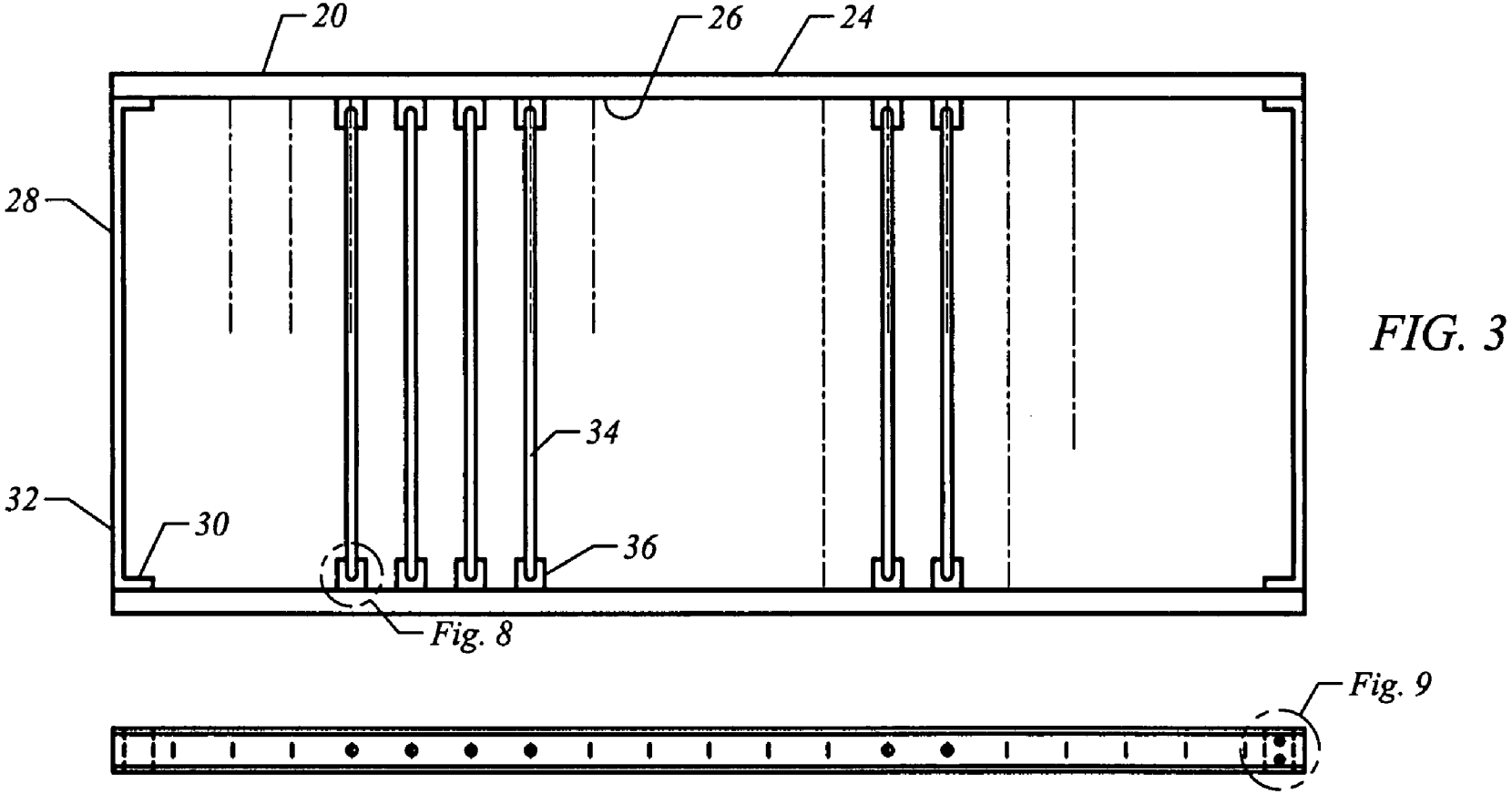
FIG. 3 is a top view of the steel deck frame for the floating dock module of FIG. 1.
FIG. 4 is a side elevational view of the steel deck frame of FIG. 3.
Figure 5:
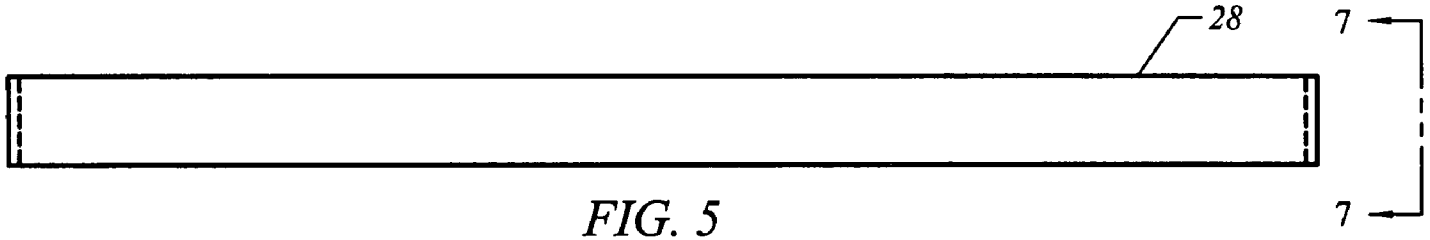
FIG. 5 is an end elevational view of an end member of the steel deck frame of FIG. 3.
Figure 6:
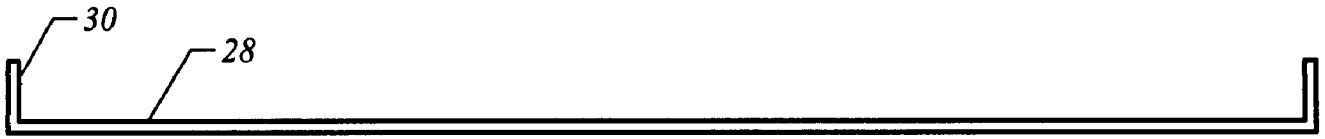
FIG. 6 is a top view of the end member of FIG. 5
Figure 7:
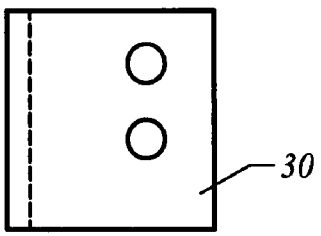
FIG. 7 is a side elevational view of the end member of FIG. 5.

As shown in FIGS. 3 and 4, the steel frame assembly 20 for each dock module 12 has two elongated side members 24 formed of twenty foot length, eight inch channels with the flat sides 26 inwardly positioned. The elongated channel members 24 are connected to end members 28 formed of one-half inch by five inch plate with bent or welded end tabs 30 as shown in FIGS. 5-7. The end plate members 28 if bent are preferably formed at a metal fabricator to achieve a uniformity in the length of the end plate members 28. Preferably, the end tabs 30 can be welded to the end member lengths 32 for accurate sizing with some acceptable loss in structural integrity.

Figure 8:
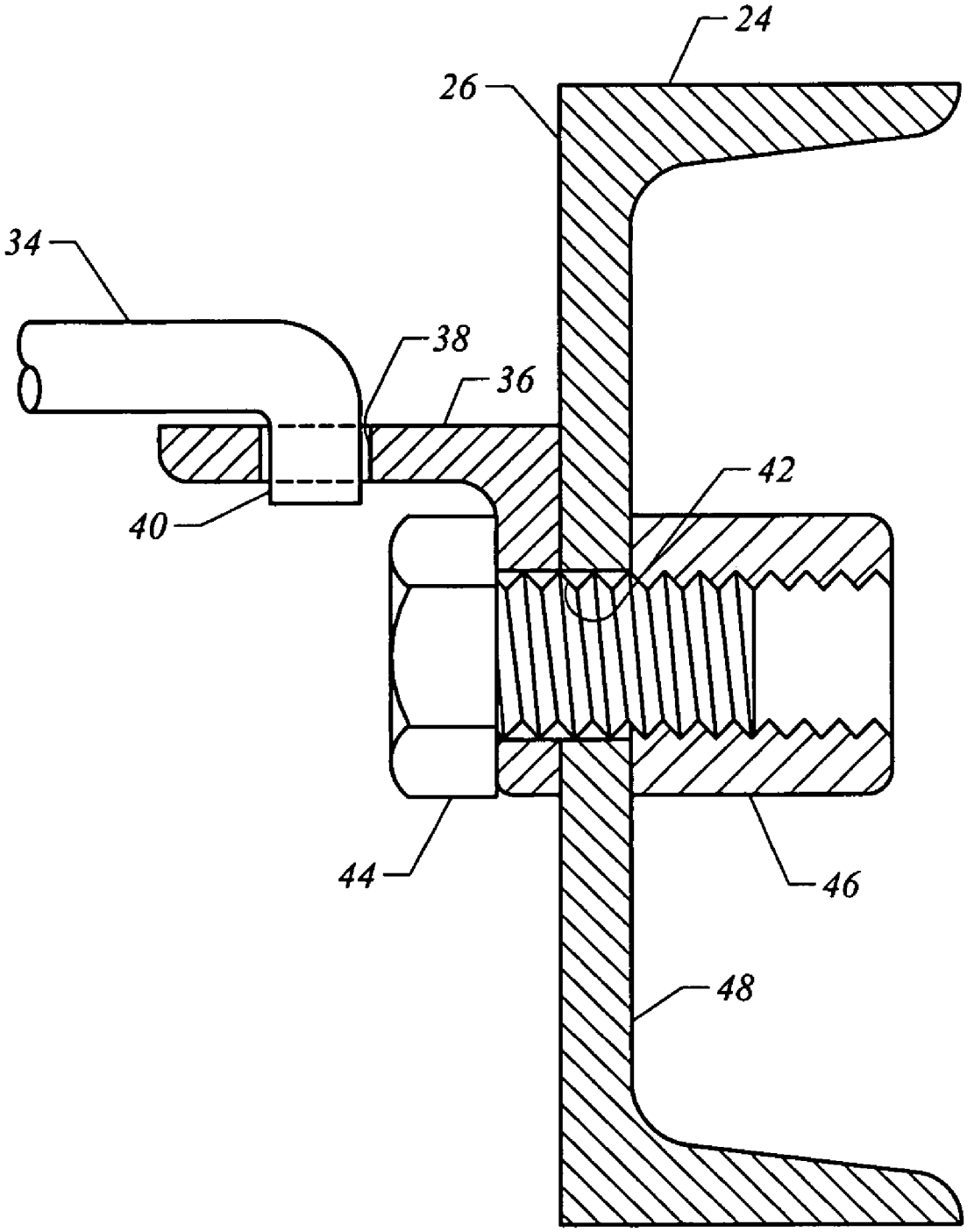
FIG. 8 is across sectional view of a clip assembly for a concrete deck of the dock module taken on the lines 8-8 in FIG. 3.

Between the end plate members 24 on one foot centers are reinforcing rods 34 (one shown). The reinforcing rods 34 are connected to a series of clips 36 that are secured to the side members 24 as shown in the enlarged view of FIG. 8. The clips 36 in one embodiment are segments of angle iron with a receiving hole 38 to receive a bent end 40 of the rod 34 and a bolting hole 42 to accommodate a seven-eighths inch bolt 44 which secures the clip 36 to the flat side 26 of the channel member 24 with a nut 46. Use of a single bolt 44 allows the clip 36 to pivot and invert to position the rods 34 at the optimal depth for the concrete deck 22 when poured. Typically, the concrete of the deck 22 can vary from 2-½" to 4". Alternately, the reinforcing rods 34 can be welded to the clips 36. The nut 46 is preferably a double nut to provide an anchor for an outer bumper stringer (not shown) that fills the channel side 48 of the channel member 24. Alternately, the double nut 46 can be employed to anchor dock fingers or other collateral apparatus to the side of the dock modules 12.

Figure 9:
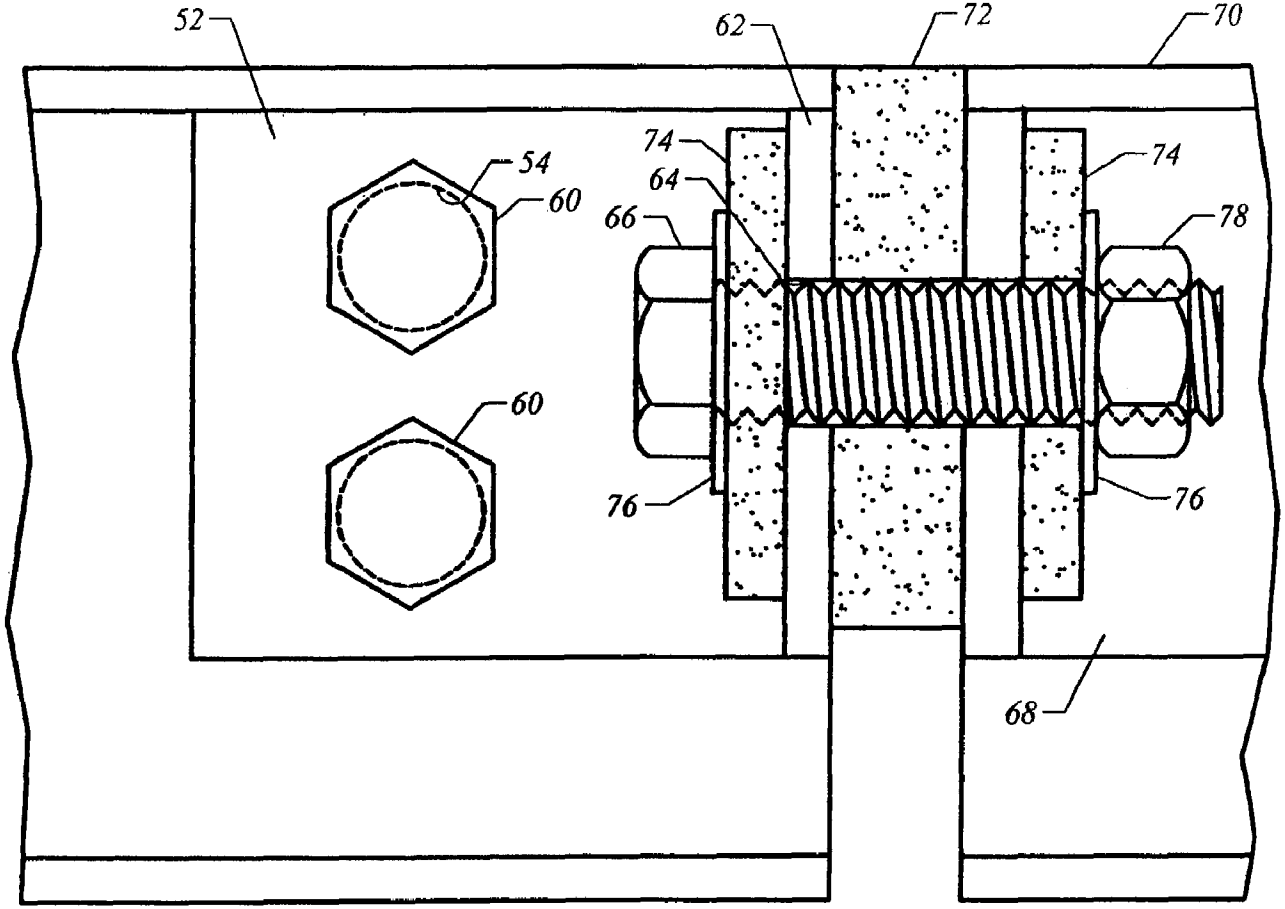
FIG. 9 is a cross sectional view of an end connector for interconnecting adjacent dock modules taken on the lines 9-9 in FIG. 3.
Figure 10:
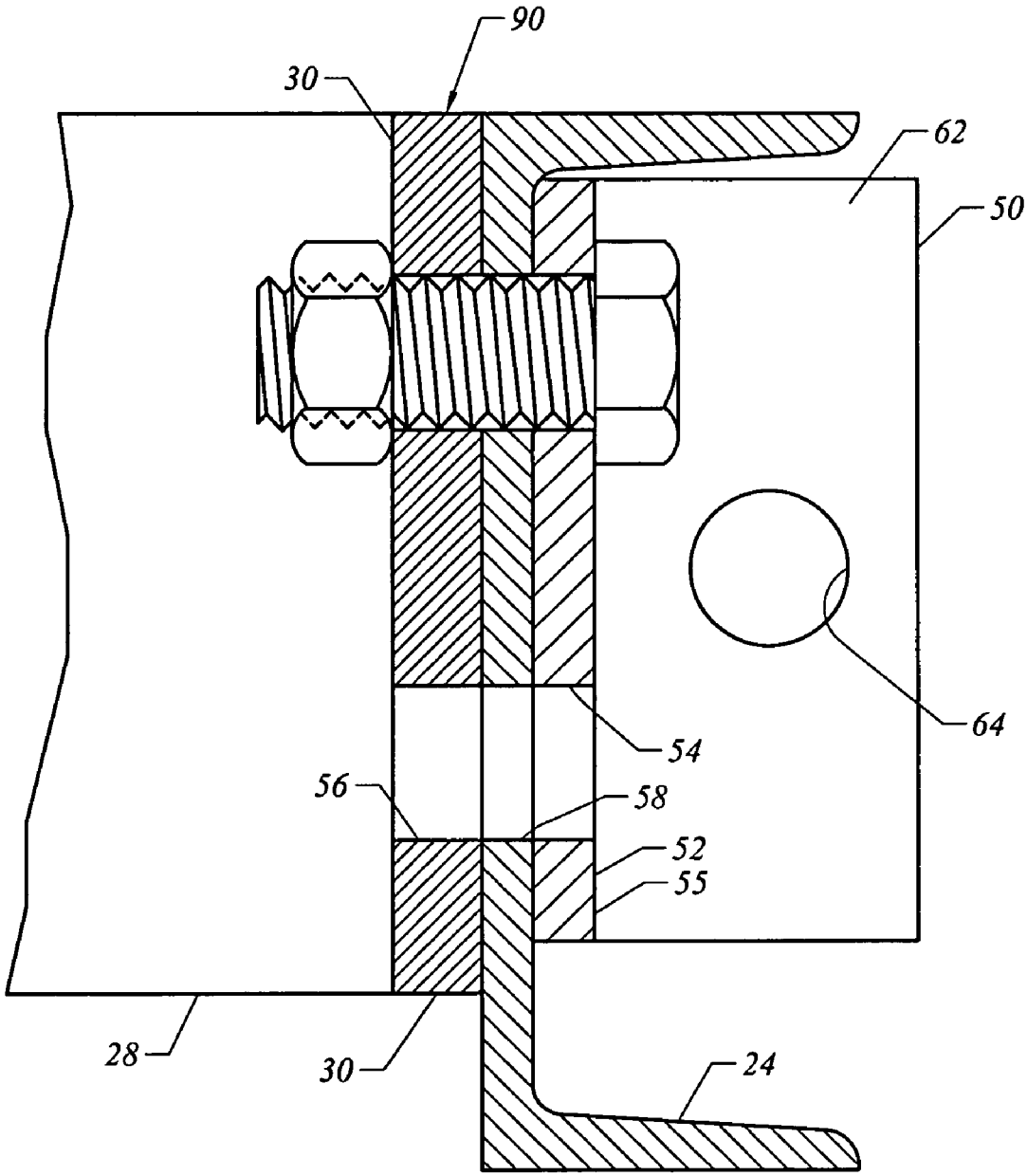
FIG. 10 is a cross sectional view of the end connector taken on the lines 10-10 in FIG. 9.

To interconnect the dock modules 12 to one another, a clip assembly 50 as shown in FIGS. 9 and 10 is utilized. The devised interconnection system for connecting adjacent dock modules 12 to one another, end to end, must be simple and strong. Referring to FIGS. 9 and 10, each clip assembly 50 has a right angle interconnector clip 52 with two bolting holes 54 on once face 55 that allows the interconnector clip 52 to connect to the end tab 30 of the end member 28 through holes 56 in the end tab 30 and holes 58 in the channel member 24 by bolts 60 shown in FIG. 9.

On the other right angle face 62 of the interconnector clip 52, a large hole 64 permits a one-inch bolt 66 to connect the clip 52 to a connector clip 68 on an adjacent module 70 as shown in part in FIG. 9.

To accommodate stresses from wave action and other forces, the interconnection assembly includes a primary shock pad 72 of EPDM rubber or other similar material interposed between adjacent modules 12, and a pair of seating pads 74 between the bolt washers 76 for the interconnecting bolt 66 and fastening nut 78.

Since the primary interconnection is openly provided at each side by two large bolts installed on the outside of the deck assembly, the interconnection of adjacent modules becomes a relatively easy task.

Figure 11:
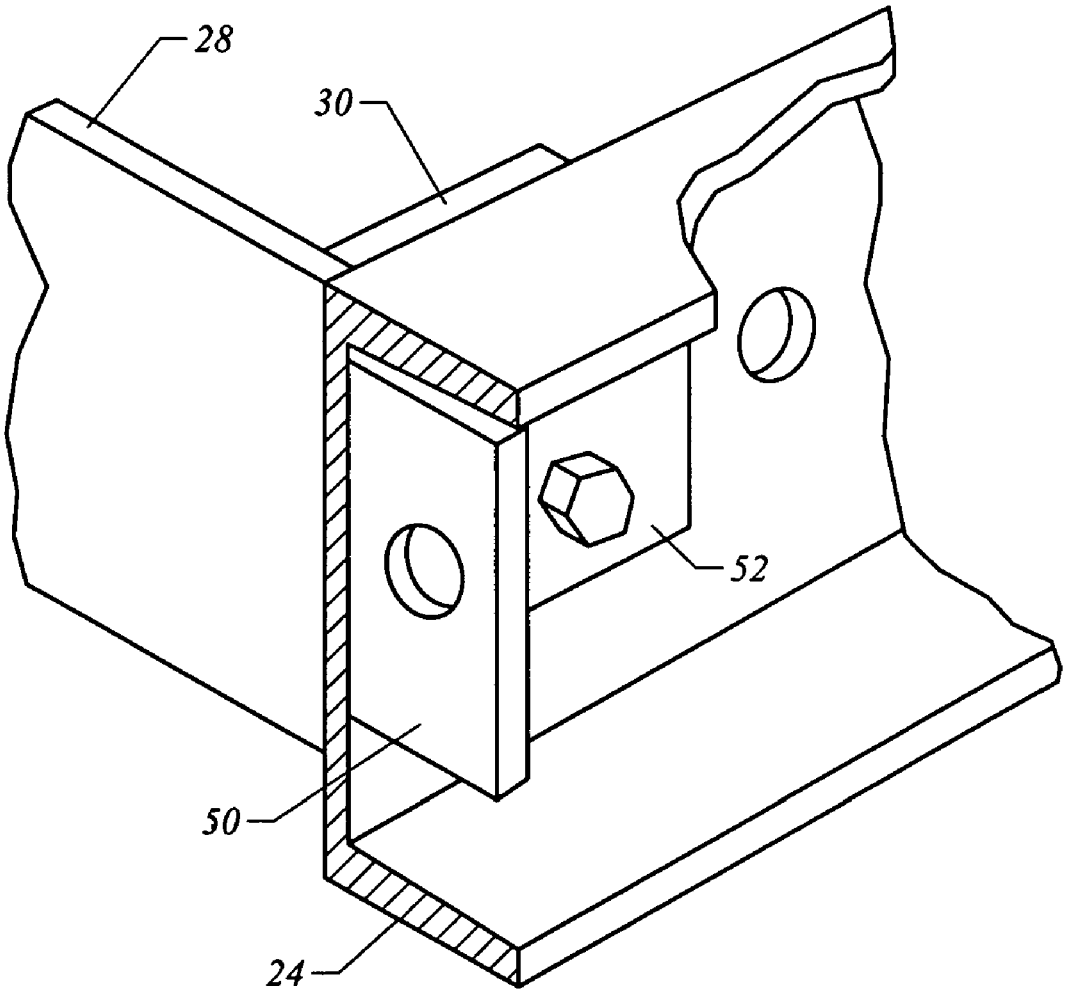
FIG. 11 is a perspective view of a segmented part of a corner of the deck frame.

As shown in the perspective view of FIG. 11, the clip assembly 50 is shown with the right angle interconnector clip 52 installed and connected to one of the side members 24 and to the end tab 30 of the end member 28. Because the interconnector end clip 52 is nested in the outwardly directed channel of the elongated side member 24, it is easily accessed during the assembly of the dock system when interconnecting adjacent modules.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The invention claimed is:

1. A deck frame for a floating dock module for a floating dock system, comprising:

a perimeter frame having:

two elongated channel members with ends with each channel member having a flat side and a channel side;

two end members wherein the end members interconnect the elongated channel members at the ends of the channel members wherein a rectangular deck structure is formed with the channel sides of the channel members facing outwardly;

right angle interconnector clips having perpendicular faces with one face nested in the channel side of the channel members and the other face located at the ends of the channel members, the interconnector clips being fastened to the channel members;

interconnector clips accessible for interconnection of one deck frame to another; and, interframe fasteners engaging the connector clips wherein on interconnection of one deck frame to another, the faces of opposing interconnector clips on adjacent frames are positioned to abut and, when the frame fasteners are engaged, the fasteners secure opposing interconnector clips together connecting one frame to the other.

2. The deck frame of claim 1 further comprising a series of reinforcing rods having opposite ends wherein the rectangular deck structure has spaced apart elongated channel members and the ends of the reinforcing rods are connected to the spaced apart channel members for strength when concrete fills the deck frame to form a deck.

3. The deck frame of claim 2 wherein the deck frame is filled with concrete wherein a deck is formed and at least one float is connected to the deck wherein a floating dock module is formed.

4. The deck frame of claim 2 wherein the elongated channel members have clips bolted along the flat side of each channel member wherein the ends of the series of reinforcing rods engage the channel clips and are supported by the channel clips.

5. The deck frame of claim 1 wherein the two end members have end tabs wherein the end tabs abut the flat sides of the channel members and are secured to the channel members at the ends of the channel members.

6. The deck frame of claim 5 wherein the end tabs, the ends of the channel members, and the faces of the interconnector clips that are nested in the channel side of the channel members have alignable bolt holes, the deck frame including bolt fasteners inserted through aligned bolt holes and securing the end members and interconnector clips to the channel members to form a frame structure.

7. The deck frame of claim 1 in combination with another deck frame wherein the deck frames have ends and, when positioned end to end, the opposing interconnector clips on adjacent ends of the deck frames have faces that abut with a shock element maintaining the separation of abutting faces.

8. The deck frame of claim 7 wherein the shock element is a shock pad interposed between abutting faces of opposing interconnector clips.

9. The deck frame of claim 7 wherein the interframe fasteners include at least one shock element.

10. The deck frame of claim 9 wherein the interframe fasteners include a bolt assembly with seating pads.

11. The deck frame of claim 10 wherein the bolt assembly of the interframe fasteners includes a single bolt of suitable size engaging opposing interconnector clips with abutting faces separated by a shock pad with the bolt passing through a complimentary hole in the clips and pad, the bolt assembly also including a nut and pair of washers with the seating pads engaging the washers and the opposing interconnector clips located between the seating pads when the interframe fasteners interconnect adjacent end to end deck frames.

12. The deck frame combination of claim 7 wherein the deck frames are filled with concrete and include floats to form connected modules of a floating dock system.

* * * * *